US008336224B2

(12) United States Patent
Arnold

(10) Patent No.: US 8,336,224 B2
(45) Date of Patent: Dec. 25, 2012

(54) MEASURING DEVICE

(75) Inventor: Yan Arnold, Marin (CH)

(73) Assignee: Hommel-Etamic GmbH, Villingen-Schwenningen (DE)

( * ) Notice: Subject to any disclaimer, the term of this patent is extended or adjusted under 35 U.S.C. 154(b) by 88 days.

(21) Appl. No.: 12/923,412

(22) Filed: Sep. 20, 2010

(65) Prior Publication Data

US 2011/0119943 A1 May 26, 2011

(30) Foreign Application Priority Data

Sep. 22, 2009 (DE) ..... 10 2009 042 252

(51) Int. Cl.
*G01B 5/00* (2006.01)
*G01B 3/38* (2006.01)

(52) U.S. Cl. ..... 33/555.1; 33/556

(58) Field of Classification Search ..... 33/555.1, 33/555.3, 549, 550, 551, 553, 556, 501.02, 33/501.03, 501.04
See application file for complete search history.

(56) References Cited

U.S. PATENT DOCUMENTS

| | | | | |
|---|---|---|---|---|
| 1,425,283 | A | 8/1922 | Pratt | |
| 1,557,903 | A | 10/1925 | Tomherg | |
| 1,815,049 | A | 7/1931 | Cole | |
| 1,892,005 | A | 12/1932 | Richmond | |
| 1,941,456 | A * | 1/1934 | Aronld | 33/556 |
| 2,408,672 | A | 10/1946 | Mennesson | |
| 2,603,043 | A | 7/1952 | Bordemps | |
| 2,789,354 | A | 4/1957 | Polldor et al. | |
| 2,909,873 | A | 4/1957 | Fisk | |
| 2,949,708 | A | 8/1960 | Butterworth et al. | |
| 3,157,971 | A | 11/1964 | Snyder | |
| 3,352,022 | A | 10/1965 | Fisk | |
| 3,274,893 | A | 9/1966 | Witzke | |
| 3,321,869 | A | 5/1967 | Parreila at al. | |
| 3,352,065 | A | 11/1967 | Enkelmann | |
| 3,386,178 | A | 6/1968 | Arnold et al. | |
| 3,388,178 | A | 6/1968 | Arnold at al. | |

(Continued)

FOREIGN PATENT DOCUMENTS

DD 88446 3/1972

(Continued)

OTHER PUBLICATIONS

EP0859689 A1 English language Abstract (1 pg.).

(Continued)

*Primary Examiner* — Yaritza Guadalupe-McCall
(74) *Attorney, Agent, or Firm* — Shlesinger, Arkwright & Garvey LLP

(57) ABSTRACT

Measuring device for in-process measurement of test specimens during a machining process on a machine tool, in particular a grinding machine, has a measuring head connected pivotably about a first pivot axis to a base body of the measuring device via a linkage, for providing an apparatus for pivoting measuring head in and out of a measuring position. Linkage has a first linkage element and a second linkage element arranged pivotably about first pivot axis. A third linkage element is connected pivotably about a second pivot axis to the end of second linkage element facing away from first pivot axis. A fourth linkage element is connected pivotably about a third pivot axis to the end of third linkage element facing away from second pivot axis, fourth linkage element being connected pivotably about a fourth pivot axis to first linkage element at a distance from third pivot axis.

27 Claims, 9 Drawing Sheets

U.S. PATENT DOCUMENTS 3,603,044 A 9/1971 Price
3,648,377 A 3/1972 Witzke
3,663,190 A 5/1972 Fisk
3,688,411 A 9/1972 Asano et al.
3,694,970 A 10/1972 Schoonover et al.
3,777,441 A 12/1973 Kurimoto et al.
3,793,775 A 2/1974 Ishikawa et al.
3,802,087 A 4/1974 Raiteri
3,863,352 A 2/1975 Peonski
3,987,552 A 10/1976 Raiteri
4,106,241 A 8/1978 Fisk
4,141,149 A 2/1979 George et al.
4,175,462 A 11/1979 Simon
4,176,461 A * 12/1979 Gebel et al. ..... 33/555.1
4,244,110 A * 1/1981 Fournier ..... 33/561
4,351,115 A 9/1982 Possati
4,414,748 A 11/1983 Gauler et al.
4,429,464 A 2/1984 Burrus
4,437,239 A 3/1984 Possati
4,480,412 A 11/1984 Shank et al.
4,485,593 A 12/1984 Munzing et al.
4,524,546 A 6/1985 Hoover et al.
4,596,076 A 6/1986 Sigg
4,606,130 A 8/1986 Vetter
4,625,413 A 12/1986 Possati et al.
4,637,144 A * 1/1987 Schemel ..... 33/550
4,651,438 A 3/1987 Hutter et al.
4,679,331 A 7/1987 Koontz
4,807,400 A 2/1989 Corallo et al.
4,819,195 A 4/1989 Bell et al.
4,903,413 A 2/1990 Bellwood
4,958,442 A 9/1990 Eckhardt
5,021,650 A 6/1991 Rieder et al.
5,054,205 A 10/1991 Danielli
5,058,325 A 10/1991 Pineau
5,077,908 A 1/1992 Moore
5,086,569 A 2/1992 Possati et al.
5,088,207 A 2/1992 Betsill et al.
5,097,602 A 3/1992 Cross et al.
5,099,585 A 3/1992 Liskow
5,123,173 A 6/1992 Possati
5,136,527 A 8/1992 Koretz
5,150,545 A 9/1992 Esteve
5,337,485 A 8/1994 Chien
5,419,056 A 5/1995 Breitenstein
5,479,096 A 12/1995 Szczyrbak et al.
5,542,188 A 8/1996 Ertl et al.
5,551,814 A 9/1996 Hazama
5,551,906 A 9/1996 Helgren
5,758,431 A 6/1998 Golinelli
5,761,821 A 6/1998 Laycock
5,771,599 A 6/1998 Uchimura et al.
5,902,925 A 5/1999 Crispie et al.
5,914,593 A 6/1999 Arms et al.
5,919,081 A 7/1999 Hykes et al.
5,956,659 A 9/1999 Spies et al.
5,982,501 A 11/1999 Benz et al.
6,029,363 A 2/2000 Masreliez et al.
6,062,948 A 5/2000 Schiff et al.
6,067,721 A 5/2000 Dall'Aglio et al.
6,088,924 A 7/2000 Esteve
6,116,269 A 9/2000 Maxson
6,159,074 A 12/2000 Kube et al.
6,167,634 B1 1/2001 Pahk et al.
6,256,898 B1 7/2001 Trionfetti
6,266,570 B1 7/2001 Hocherl et al.
6,298,571 B1 * 10/2001 Dall'Aglio et al. ..... 33/555.1
6,304,827 B1 10/2001 Blixhavn et al.
6,321,171 B1 11/2001 Baker
6,415,200 B1 7/2002 Kato et al.
6,430,832 B1 * 8/2002 Dall'Aglio et al. ..... 33/555.1
6,487,787 B1 12/2002 Nahum et al.
6,487,896 B1 12/2002 Dall'Aglio
6,511,364 B2 1/2003 Ido et al.
6,560,890 B1 5/2003 Madge et al.
6,568,096 B1 5/2003 Svitkin et al.
6,643,943 B2 * 11/2003 Dall'Aglio et al. ..... 33/555.3
6,645,047 B1 11/2003 Liskow
6,711,829 B2 3/2004 Sano et al.
6,848,190 B2 * 2/2005 Dall'Aglio et al. ..... 33/555.3
6,931,749 B2 8/2005 Dall'Aglio
6,952,884 B2 * 10/2005 Danielli ..... 33/555.1
6,955,583 B2 10/2005 Dall'Aglio
7,020,974 B2 * 4/2006 Danielli et al. ..... 33/555.3
7,024,785 B2 * 4/2006 Dall'Aglio et al. ..... 33/555.3
7,047,658 B2 5/2006 Danielli et al.
7,325,324 B2 * 2/2008 Dall'Aglio et al. ..... 33/555.3
7,464,482 B2 * 12/2008 Dall'Aglio et al. ..... 33/555.3
7,607,239 B2 10/2009 Dall'Aglio et al.
7,665,222 B2 2/2010 Dall'Aglio
7,690,127 B2 * 4/2010 Dall'Aglio et al. ..... 33/555.3
7,954,253 B2 * 6/2011 Dall'Aglio et al. ..... 33/555.1
2002/0020075 A1 * 2/2002 Dall'Aglio et al. ..... 33/555.1
2002/0066179 A1 6/2002 Hall et al.
2002/0155790 A1 10/2002 Ido et al.
2002/0166252 A1 11/2002 Dall'Aglio et al.
2003/0009895 A1 1/2003 Dall'Aglio
2003/0056386 A1 * 3/2003 Danielli et al. ..... 33/555.1
2004/0045181 A1 3/2004 Dall'Aglio et al.
2004/0055172 A1 * 3/2004 Danielli ..... 33/555.1
2004/0137824 A1 7/2004 Dall'Aglio
2005/0178018 A1 8/2005 Dall'Aglio et al.
2005/0217130 A1 10/2005 Danielli et al.
2007/0039196 A1 * 2/2007 Dall'Aglio et al. ..... 33/555.3
2008/0155848 A1 7/2008 Dall'Aglio et al.
2009/0113736 A1 * 5/2009 Dall'Aglio et al. ..... 33/555.3
2010/0000109 A1 * 1/2010 Dall'Aglio et al. ..... 33/555.1
2011/0001984 A1 * 1/2011 Keller et al. ..... 356/612
2011/0119943 A1 * 5/2011 Arnold ..... 33/556
2011/0232117 A1 * 9/2011 Arnold ..... 33/555.1
2011/0239478 A1 * 10/2011 Dall'Aglio et al. ..... 33/555.3

FOREIGN PATENT DOCUMENTS

DE 2 146 360 3/1972
DE 4412882 10/1995
DE 4419656 1/1996
DE 297 22 951 U1 4/1998
DE 600 15 654 T2 8/2005
DE 10 2008 016 228 A1 10/2009
EP 0 068 082 A2 1/1983
EP 0105627 4/1984
EP 0 322 120 A2 6/1989
EP 0 382 336 A2 8/1990
EP 0469 439 A1 2/1992
EP 0 480 222 A2 4/1992
EP 0 810 067 A1 12/1997
EP 0 859 689 A1 8/1998
EP 0 859 689 B1 8/1998
EP 0859689 A 8/1998
EP 0 878 704 A1 11/1998
EP 0 903 199 A2 3/1999
EP 1 063 052 A2 12/2000
EP 1 063 052 B1 12/2000
EP 1 118 833 7/2001
EP 1 263 547 B1 12/2002
EP 698 09 667 T2 4/2003
EP 1 370 391 11/2003
EP 1 370 391 B1 12/2003
EP 1370391 A 12/2003
EP 1 263 547 B1 12/2007
FR 758177 9/1933
GB 405 817 2/1934
GB 1361276 7/1974
GB 1362996 8/1974
GB 2086778 A 5/1982
GB 2 161 101 A 1/1986
GB 2 197 477 A 5/1988
GB 2 300 582 A 11/1996
JP 53-4285 A 1/1978
JP 53-4286 A 1/1978
JP 55-6825 12/1979
JP 55120976 9/1980
JP 55-156801 12/1980
JP 59-93844 U 6/1984
JP 59125001 7/1984
JP 3-66553 A 3/1991
JP 3-86553 A 3/1991

| | | | |
|---|---|---|---|
| JP | 10-118974 | A | 5/1998 |
| JP | 11-513317 | A | 11/1999 |
| WO | WO 83/04302 | | 12/1983 |
| WO | WO 90/00246 | | 1/1990 |
| WO | WO 92/14120 | | 8/1992 |
| WO | WO 94/17361 | | 8/1994 |
| WO | WO 97/12724 | | 4/1997 |
| WO | WO 97/13614 | | 4/1997 |
| WO | WO-A-9712724 | | 4/1997 |
| WO | WO 97/40434 | | 10/1997 |
| WO | WO 99/47884 | | 9/1999 |
| WO | WO 02/70195 | | 9/2002 |
| WO | WO 02/90047 | A1 | 11/2002 |

OTHER PUBLICATIONS

German Patent and Trademark Office (EPMA) Office Action in counterpart German priority application No. 10 2009 042, filed Sep. 22, 2009, dated Apr. 7, 2010 (3 pgs.).
Office Action in counterpart European patent application No. EP 10 00 9546 from European Patent Office (EPO), dated Nov. 2010 (4 pgs.).
Portion of Maracas Catalogue (circa 1970).
Leaflet —Fenar Marposs (1991).
"Crankshaft Gauging Machines," Hommelwerke (1985).
PCT Intl. Search Report for App. No. PCT/EP 00/128076 (mailed Feb. 26, 2003).
PCT Intl. Search Report for App. No. PCT/EP 01/00596 (mailed Aug. 15, 2001).
PCT Intl. Search Report for App. No. PCT/EP 02/02022 (mailed Jul. 9, 2002).
PCT Intl. Search Report for App. No. PCT/EP 02/04394 (matted Sep. 27, 2002).
PCT Intl. Search Report for App. No. PCT/EP 03/05740 (mailed Oct. 30, 2003).
PTO Communication Mailed Jan. 23, 2008 in Response to Suggestion of Interference Filed Feb. 28, 2008, 10 pages.
Office Action dated Jan. 28, 2011 in German Application No. 10 2010 035 147.4, filed Aug. 23, 2010 (3 pgs.).
European Search Report in EP 11001656, dated Jun. 9, 2011 (3 pgs.).
German Search Report in DE 10 2010 013 069, dated Sep. 23, 2010 (3 pgs.).

* cited by examiner

MEASURING DEVICE

CROSS-REFERENCE TO RELATED APPLICATION

This application claims the priority of German application no. 10 2009 042 252.8, filed Sep. 22, 2009, and which is incorporated herein by reference.

FIELD OF THE INVENTION

The invention relates to a measuring device. More particularly, the invention relates to a measuring device for in-process measurement of test specimens during a machining process on a machine tool, in particular a machine tool such as a grinding machine.

BACKGROUND OF THE INVENTION

During production of crankshafts it is necessary to grind the crankpin of the crankshaft to size on a grinding machine. In order to ensure that the grinding process terminates as soon as a desired dimension has been attained it is necessary to check the crankpin continuously using an in-process measuring method during the machining process, in particular with regard to its diameter and roundness. EP-A-0859689 discloses such a measuring device.

Known from EP-A-1370391 is a measuring device of this type that is used for in-process measuring of crankpins during a grinding process on a grinding machine. The known measuring device has a measuring head that is connected pivotably about a first pivot axis to a base body of the measuring device via a linkage. The known measuring device furthermore has means for pivoting the measuring head in and out of a measuring position respectively. For performing an in-process measurement on a crankpin, the measuring head is pivoted inwardly by the means provided for this purpose into a measuring position in which the measuring head is positioned, for instance by means of a measuring prism, against the crankshaft to be measured. During the grinding process, the crankpin performs an orbital rotation about the rotational axis of the crankshaft. The grinding wheel remains in contact with the crankpin and to this end is movably carried radially to the rotational axis of the crankshaft. The measuring head reproduces the movements of the crankpin in order to ensure that measurements can be performed on the crankpin during the entire grinding process. To this end the base body of the measuring device is connected to a base body of the grinding machine so that the measuring device is moved in the radial direction of the crankshaft synchronously with the grinding wheel of the grinding machine during the grinding process.

OBJECTS AND SUMMARY OF THE INVENTION

An object of the invention is to overcome the drawbacks of the PRIOR ART measuring devices.

An object of the invention is to provide a measuring device of this type that is simple in construction and that has a space-saving configuration.

In sum, the measuring device for in-process measurement of test specimens during a machining process on a machine tool having a base body includes:

a) a measuring head connected pivotably about a first pivot axis to the base body of the measuring device via a linkage;

b) an apparatus provided for pivoting the measuring head in and out of a measuring position, respectively;

c) a linkage provided including:

i) a first linkage element and a second linkage element that are provided pivotably on the first pivot axis;

ii) a third linkage element connected pivotably about a second pivot axis to the end of the second linkage element facing away from the first pivot axis; and iii) a fourth linkage element connected pivotably about a third pivot axis to the end of the third linkage element that faces away from the second pivot axis, and the fourth linkage element being connected pivotably about a fourth pivot axis to the first linkage element at a distance from the third pivot axis.

This object is likewise achieved by the invention which provides that the linkage has a first linkage element and a second linkage element that are arranged pivotably about the first pivot axis. The invention furthermore provides that a third linkage element is connected pivotably about a second pivot axis to the end of the second linkage element facing away from the first pivot axis, and a fourth linkage element is connected pivotably about a third pivot axis to the end of the third linkage element that faces away from the second pivot axis, the fourth linkage element being connected pivotably about a fourth pivot axis to the first linkage element at a distance from the third pivot axis. Because of the inventive embodiment of the linkage, it pivots under particularly favorable kinematic conditions between a rest position, in which the measuring head is retracted out of the region of the grinding wheel, into a measuring position, in which the measuring head is in contact with the test specimen to be measured, for example a crankpin of a crankshaft. Due to the selected kinematics of the inward pivoting movement, while the measuring head approaches the test specimen the measuring head is positioned securely against the test specimen without there being the risk that the measuring head will come into contact with the grinding wheel and suffer damage. Moreover, the kinematics provided according to the invention are particularly advantageous with regard to the fact that during the measuring process the measuring head reproduces movements of the test specimen, at least across a certain area, for example one rotation of a crankpin of a crankshaft about the rotational axis of the crankshaft.

Another advantage of the measuring device according to the invention is that it is configured in a relatively space-saving manner. This is particularly significant given the constrained spaces when integrating such a measuring device into a grinding machine.

Another advantage of the device according to the invention is that it is of relatively simple construction and is thus maintenance-friendly and robust.

For instance, if the inventive measuring device is for measuring a crankpin on a crankshaft, during a typical measuring process the measuring head moves for example with an angular stroke of −7° and +5°, that is, a total of approximately 12°, in the circumferential direction of the crankpin. This relative movement by the measuring head in the circumferential direction of the crankpin may be included in the evaluation of the measured values recorded by means of the measuring sensor.

Pivoting in and out shall be understood to mean a movement according to the invention by the measuring head between its rest position and a measuring position in which the measuring head is positioned against the test specimen to be measured, regardless of the path the measuring head describes during its movement between the rest position and the measuring position. In particular the measuring head may move along any desired path, for instance a parabolic path, between its rest position and its measuring position. The measuring device according to the invention is particularly well suited for in-process measurement of test specimens during a machining process on a machine tool. The inventive measuring device is also suitable for performing measurements outside of a machining process, however.

The linkage elements of the measuring device according to the invention are preferably embodied as being rigid.

One advantageous refinement of the invention provides that the first linkage element and the second linkage element are arranged such that they are not parallel to one another. In this manner particularly favorable conditions result with regard to the kinematics of the measuring head when it pivots in and out and during the measuring process.

In order to further improve the kinematic conditions when the measuring head moves between its rest position and its measuring position, another advantageous refinement of the invention provides that the distance between the first pivot axis and the second pivot axis is shorter than the distance between the third pivot axis and the fourth pivot axis.

Fundamentally, the measuring head may be connected directly to one of the linkage elements of the linkage. In order to further increase the spatial freedom when integrating the measuring device according to the invention in a machine tool, one advantageous refinement of the invention provides that the measuring head is arranged on a holding arm that is connected to one of the linkage elements, in particular the fourth linkage element.

Fundamentally, the holding arm may be movably connected according to the invention to the associated linkage element. However, for the construction of the measuring device according to the invention to be as simple as possible it is advantageous for the holding arm to be rigidly connected to one of the linkage elements, as one advantageous further refinement of the invention provides.

Other advantageous refinements of the invention provide that a free end of the holding arm holding the measuring head is angled or bent towards the first pivot axis and/or that the holding arm, or a part of the holding arm, that is connected to the associated linkage element, forms an angle greater than 90°with the associated linkage element. In this manner particularly favorable conditions result, while taking account of the kinematics selected according to the invention during the movement of the measuring head between its rest position and its measuring position with regard to the measuring head coming into contact with the test specimen.

According to the invention, the measuring head can have any desired suitable measuring sensor. The measuring principle for the measuring sensor may be selected within broader limits according to the current requirements. For instance, contactless, in particular optically-working measuring sensors may be used. In the context of a particularly simple construction and also a construction that is robust under process conditions during a machining process it is preferred that the measuring sensor is a measuring sensor that works in a tactile manner. Another advantageous further embodiment of the invention provides that the measuring head has at least one linearly deflectable measuring sensor.

The measuring head may be embodied in any desired suitable manner in order to hold the measuring sensor used in contact with the test specimen during the measuring process. One particularly advantageous refinement of the invention provides that the measuring head has at least one measuring prism. In this embodiment, the measuring head is, in the measuring position of the measuring sensor, in a 3-point contact with the test specimen, specifically at two locations on the measuring prism and circumferentially between these locations by means of the measuring sensor.

The apparatus for pivoting the measuring head in and out may have a drive, the driving principle of which can be selected within further limits. One advantageous refinement of the invention provides that the means for pivoting the measuring head in and out has at least one linear drive with a linearly movable drive unit and means for converting a linear movement by the drive unit to a pivot movement of the measuring head.

The drive force or a drive torque for pivoting the measuring head in and out may be transferred from the apparatus for pivoting the measuring head in and out to the measuring head in any desired manner. One advantageous refinement in the context of a simple structure of the device according to the invention provides that the apparatus for pivoting the measuring head in and out engages the linkage.

Corresponding to the respective requirements, the apparatus for pivoting the measuring head in and out may have a common inward and outward pivot device or the means for pivoting the measuring head in and out may have at least one inward pivot device and at least one separate outward pivot device, as other refinements of the invention provide. According to the invention, a common inward and outward pivot device may be provided corresponding to the current requirements, or a separate inward pivot device and a separate outward pivot device may be provided.

A force required for pivoting inward and outward or a torque required for pivoting inward and outward may be applied in any desired manner. One advantageous refinement of the invention provides that the apparatus for pivoting the measuring head in and out has spring device having at least one spring that acts on the measuring head. In this embodiment, a needed force or a needed torque for pivoting the measuring head in and out is applied via the spring element. In this manner a particularly simple construction results that is robust and maintenance-free, especially under process conditions.

In order to even further simplify the construction of the measuring device according to the invention, one refinement of the aforesaid embodiment provides that the spring is arranged between the base body of the measuring device and a linkage element of the linkage or a part connected thereto.

In the aforesaid embodiments, the construction of the measuring device according to the invention may be configured to be particularly simple and low-maintenance if at least one of the linkage elements, in particular the second linkage element, has a lever arm such that the lever arm together with the linkage element forms a two-armed lever, the spring acting on the lever arm as is provided in another refinement of the invention.

Corresponding to the respective requirements, the spring may be embodied as a tension spring. One advantageous refinement of the invention, however, provides that the spring is embodied as a compression spring. In this manner a particularly space-saving construction for the measuring device according to the invention results. This is particularly advantageous with respect to integrating the measuring device into a machine tool, for instance a grinding machine, for performing an in-process measuring process.

Another refinement of the invention provides that the means for pivoting the measuring head in and out has at least one hydraulic cylinder that is or can be mechanically linked to the measuring head for pivoting the latter in and out. Such hydraulic cylinders are available for relatively simple, cost-effective, and low-maintenance standard components and make it possible to precisely control the process of pivoting in and out. According to the invention the apparatus for pivoting the measuring head in and out works according to any desired drive principle, for instance, by way of or use of spring force or by way of at least one hydraulic cylinder. Moreover, other drive principles may also be used, for instance, a pneumatic arrangement or at least one electric motor drive.

In order to further simplify the apparatus for pivoting in and out, one advantageous refinement of the invention provides that an engaging element is provided for pivoting the measuring head out and it acts on the measuring head, or a part connected thereto, in particular a linkage element, causing it to pivot outwardly.

In the aforesaid embodiment the engaging element is advantageously embodied as a lever that is carried pivotably about the pivot axis.

Another advantageous refinement of the embodiment with the engaging element provides that the engaging element is mechanically linked to the hydraulic cylinder.

The drive force may be transferred from one drive element of the means for pivoting the measuring head in and out to the engaging element in any desired suitable manner. In order to configure the structure in a relatively simple and low-maintenance manner, one advantageous refinement of the invention provides that the engaging element is mechanically linked via a lever arrangement to a drive element of the means for pivoting the measuring head in and out.

In order to ensure that the movement of the measuring head is slower at the beginning and at the end of an inward or outward pivot movement by the measuring head, but faster for the rest of the inward or outward pivot movement, one refinement of the aforesaid embodiment provides that the lever arrangement has a knee lever.

Another advantageous refinement of the invention provides a sensor for sensing the current (i.e. present) position of the measuring head. With this embodiment it is possible to sense the current position of the measuring head before, during, or after a movement by the measuring head and to control the position of the measuring head in a desired manner.

Another advantageous refinement of the invention provides a control for controlling the apparatus for pivoting the measuring head in and out, whereby according to another advantageous refinement the control is mechanically linked to the sensor.

The invention shall be explained in greater detail as follows using the enclosed, highly schematic drawings in which one embodiment of a measuring device according to the invention is depicted. All of the features described, depicted in the drawings, and claimed in the patent claims, in and of themselves, and in any desired combination with one another, constitute the subject matter of the invention, regardless of their summary in the patent claims and their reference to prior claims and regardless of their description or depiction in the drawings.

Relative terms such as in, out, up, and down are for convenience only and are not intended to be limiting.

DETAILED DESCRIPTION OF THE INVENTION

Figure 1:
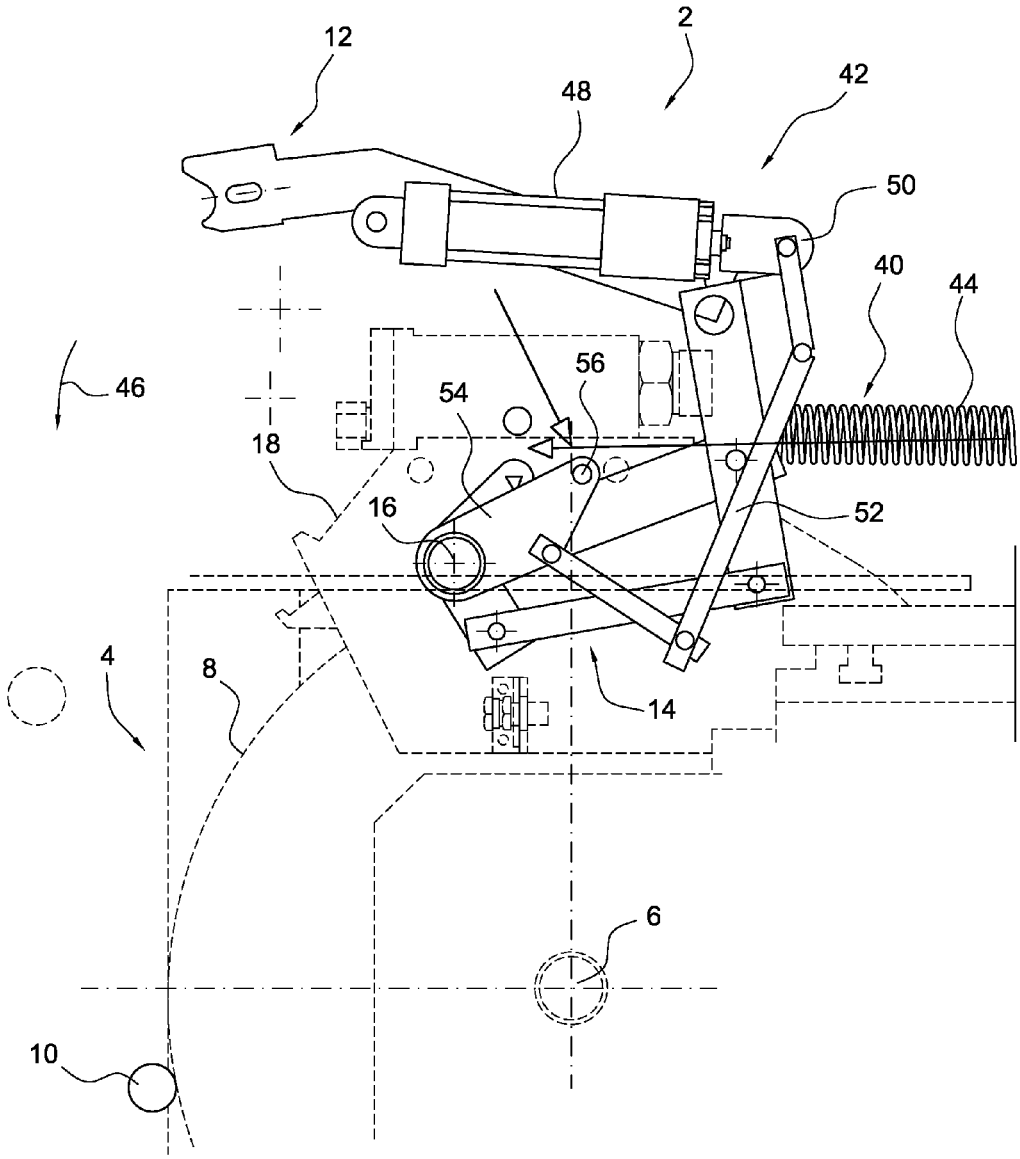
FIG. 1 is a side view, highly schematic, of an embodiment of a measuring device according to the invention, with the measuring head in a rest position.

FIG. 1 depicts an embodiment of a measuring device 2 according to the invention that performs in-process measurement of test specimens during a machining process on a grinding machine 4. The grinding machine 4, only part of which is depicted for reasons of simplification, has a grinding wheel 8 that is rotatable about a machine-fixed rotational axis 6 and that machines a test specimen that in this embodiment is formed by a crankpin 10 of a crankshaft.

The measuring device 2 has a measuring head 12 that is pivotably connected about a first pivot axis 16 to a base body 18 of the measuring device 2 via a linkage 14.

The measuring device 2 furthermore has an apparatus for pivoting the measuring head 12 into and out of a measuring position, and this device shall be explained in greater detail in the following.

Figure 2A:
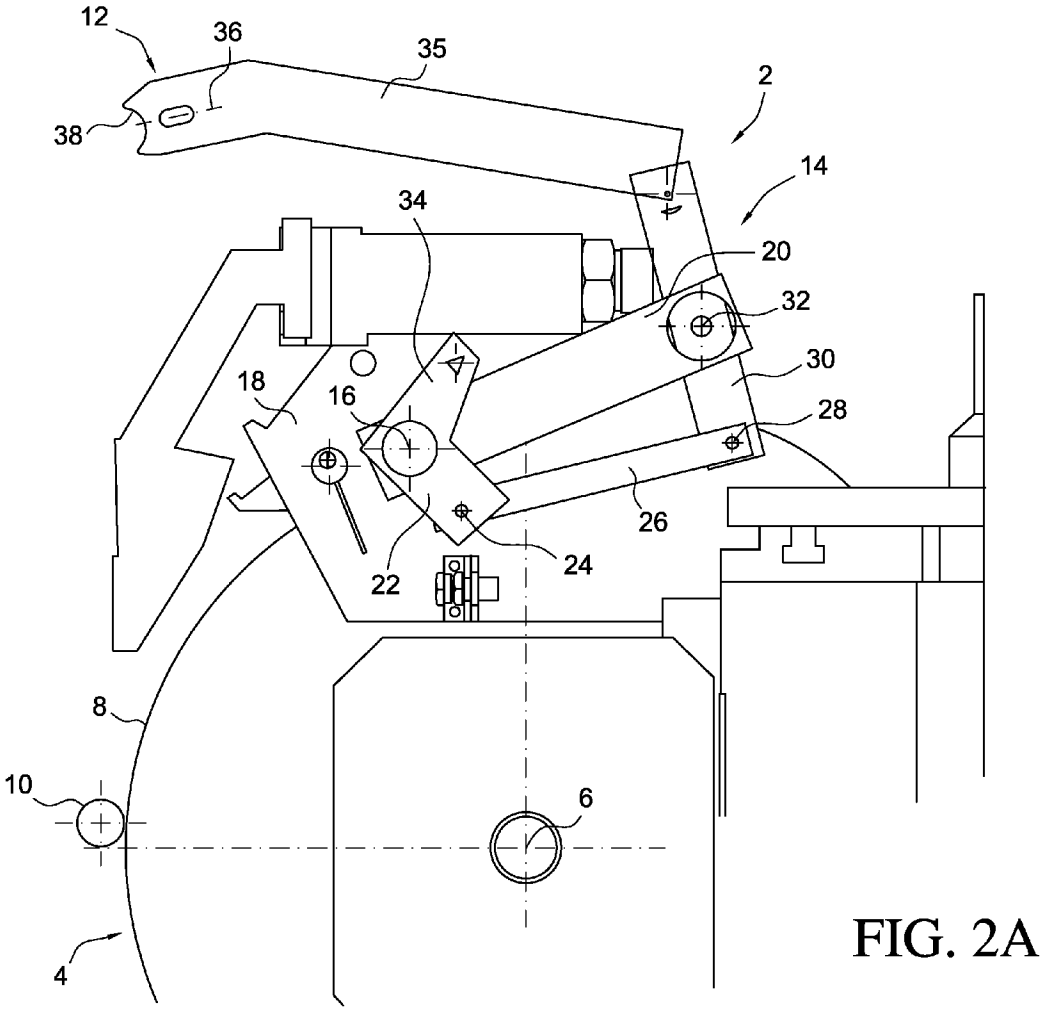
FIGS. 2A-2E depict the measuring device according to FIG. 1 in various kinematic phases.

First, the structure of the linkage 14 shall be explained in greater detail using FIG. 2*a*. In FIGS. 2A-2E, the apparatus for pivoting the measuring head 12 into and out of the measuring position is omitted in order to make the drawing easier to follow. The linkage 18 has a first linkage element 20 and a second linkage element 22 that are arranged pivotably about the first pivot axis 16. Pivotably connected about a second pivot axis 24 to the end of the second linkage element 22 that faces away from the first pivot axis 16 is third linkage element 26, to whose end that faces away from the second pivot axis 24 a fourth linkage element is pivotably connected about a third pivot axis 28, and at a distance from the third pivot axis 28 is pivotably connected about a fourth pivot axis to the first linkage element 20.

In the embodiment depicted, the first linkage element 20 and the third linkage element 26 are arranged non-parallel to one another, the distance between the first pivot axis 16 and the second pivot axis 24 being less than the distance between the third pivot axis 28 and the fourth pivot axis 32.

In the embodiment depicted, the second linkage element 22 has a lever arm 34 such that the lever arm 34 together with the linkage element 22 forms a two-armed angle lever, the function of which shall be described in greater detail below.

In this embodiment the measuring head 12 is arranged on a holding arm 35 that is connected to the fourth linkage element 30 that is extended beyond the fourth pivot axis 32. In the embodiment depicted, the connection between the holding arm 34 and the fourth linkage element 30 is embodied as being rigid. As can be seen from FIG. 2A, in the embodiment depicted a free end of the holding arm 34 holding the measuring head 12 is angled towards the first pivot axis 16, a part of the holding arm 34 that is connected to the fourth linkage element 40 forming, with the fourth linkage element 30, an angle greater than 90°.

In the embodiment depicted, the measuring head 12 has a linearly displaceable measuring sensor 36 that is indicated by a dashed line in FIG. 2*a*. The measuring head 12 in the embodiment depicted furthermore has a measuring prism 38. The manner in which roundness and/or dimension measurements are performed on a test specimen, especially a crankpin of a crankshaft or another cylindrical component, by way of an arrangement made of a linearly deflectable measuring sensor 36 and a measuring prism 38 is known in general to one of ordinary skill in the art and shall therefore not be described in greater detail here.

The measuring device 2 furthermore has an apparatus for pivoting the measuring head 12 in and out that engages on the linkage 14 and shall be explained in greater detail using FIG. 1. In the embodiment depicted, the apparatus for pivoting the measuring head 12 in and out has an inward pivot device 40 and a separate outward pivot device 42.

In the embodiment depicted, the inward pivot device 40 has a spring element that in this embodiment includes a spring 44 embodied as a compression spring and that acts on the measuring head 12 via the linkage 14 in an inward pivot direction symbolized in FIG. 1 by an arrow 46. The spring 44 in this embodiment is embodied as a compression spring and is supported at its one end on the base 18 of the measuring device 2 and at its other end on the lever arm 34 so that the spring 44 acts on the lever arm 34 counterclockwise in FIG. 1 and thus acts on the measuring head 12 by means of the linkage 14 in the inward pivot direction 46, urging it to move.

The outward pivot apparatus 42 in this embodiment has a hydraulic cylinder 48, the piston of which is connected at its free end to the base body 18 of the measuring device 2. Connected to the piston rod 50 of the hydraulic cylinder 48 is a lever arrangement 52 embodied in this embodiment as a knee lever, and its free end that faces away from the piston rod 50 is connected eccentrically to the first pivot axis 16 with a single-arm lever 54 that is borne coaxially with the pivot axis 16. At its free end the lever 54 has a pin 56 that runs into the plane of the drawing and that acts on the first linkage element 20 so that, given a movement in an outward pivot direction, which in the drawing corresponds to clockwise, the lever 54 functions as an engaging element for the first linkage element 20.

For sensing the current position of the measuring head 12, a sensor is provided that is mechanically linked to the control means for controlling the inward pivot device 40 and the outward pivot device 42.

The evaluation of measured values that are recorded by use of the measuring sensor 36 during a measuring process occurs by way of an evaluating computer. The manner in which corresponding measured values are evaluated is generally known to a person having ordinary skill in the art and shall therefore not be explained in greater detail here.

The measuring device 2 according to the invention functions as follows:

In the rest position depicted in FIG. 1 and FIG. 2A, the measuring head 12 is not in contact with the crankpin 10. In this rest position, the hydraulic cylinder 48 is disengaged so that a counterclockwise movement by the lever arm 34 in FIG. 1, which would attempt to act on the compression spring 44, is blocked.

For pivoting the measuring head 12 in the inward pivot direction 46, the hydraulic cylinder 48 is actuated such that its piston rod 50 extends to the right in FIG. 1. When the piston rod 50 extends, the spring 44 presses against the lever arm 34 so that the lever arm 34 is pivoted counterclockwise in FIG. 1. Since the lever arm 34 is connected rotation-fast (i.e., nonrotatably) to the second linkage element 22, the second linkage element 22 and thus the entire linkage 14 is now pivoted counterclockwise in FIG. 1.

Figure 2B:
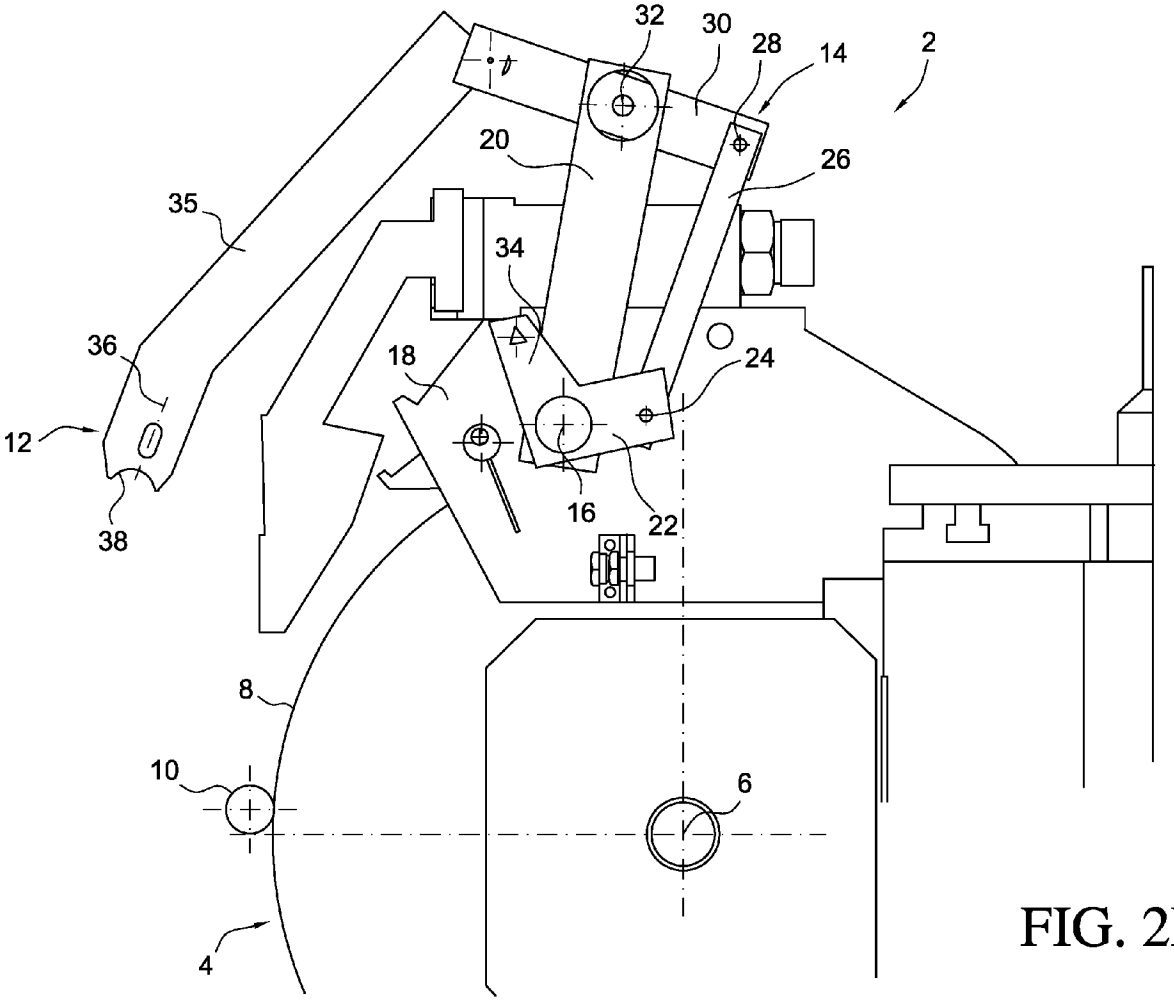

FIG. 2B depicts the measuring head 12 in a position between the rest position and the measuring position.

Figure 2C:
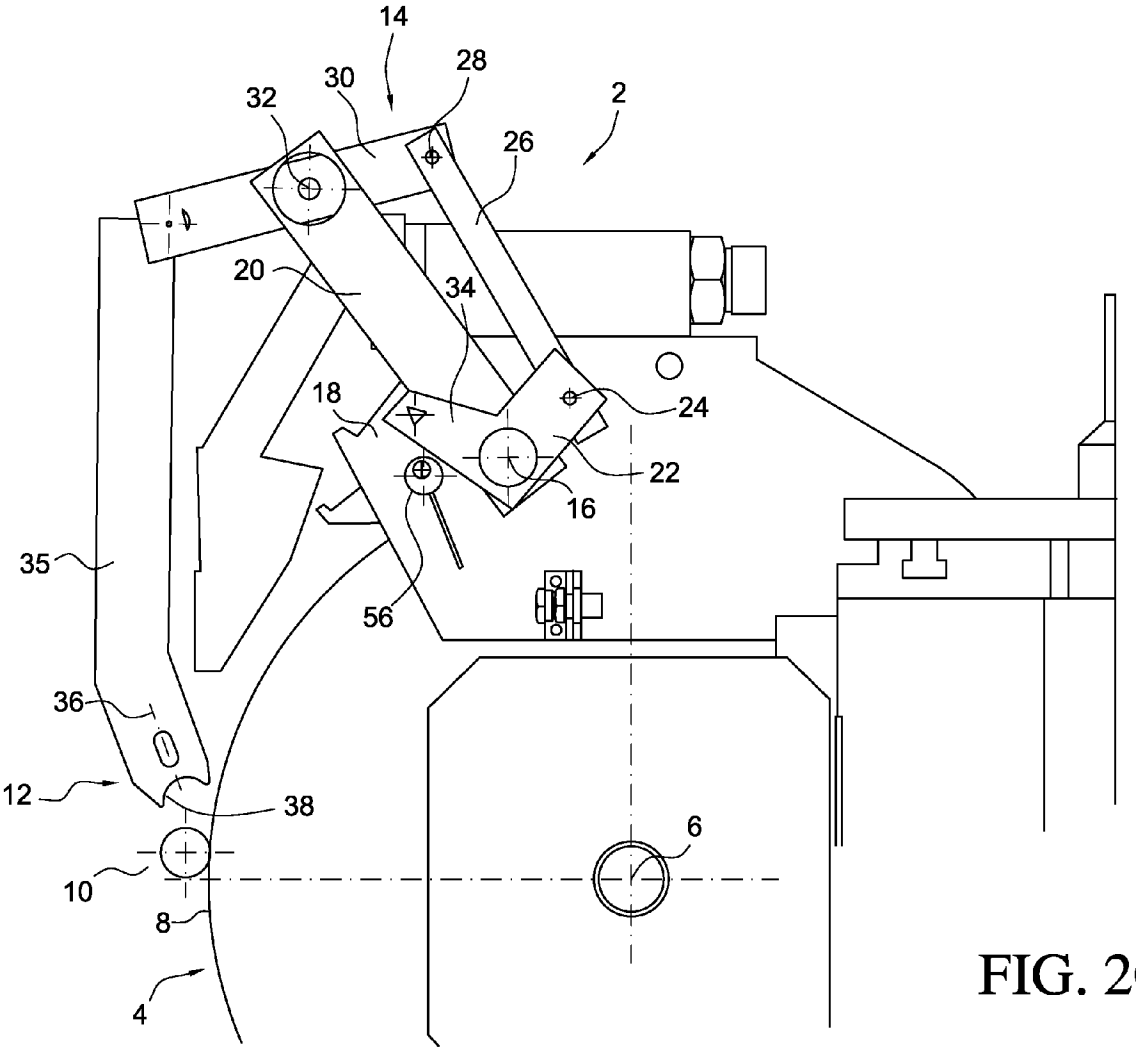

When a pre-specified angular position has been attained, as depicted in FIG. 2C, the lever arm 34 strikes a stop 56, wherein when the lever arm 34 strikes the stop 56 a control signal is transmitted to the control, causing the hydraulic cylinder 48 to be disengaged. FIG. 2C depicts the measuring head 12 in a seek position in which it is not yet in contact with the crankpin 10.

Figure 2D:
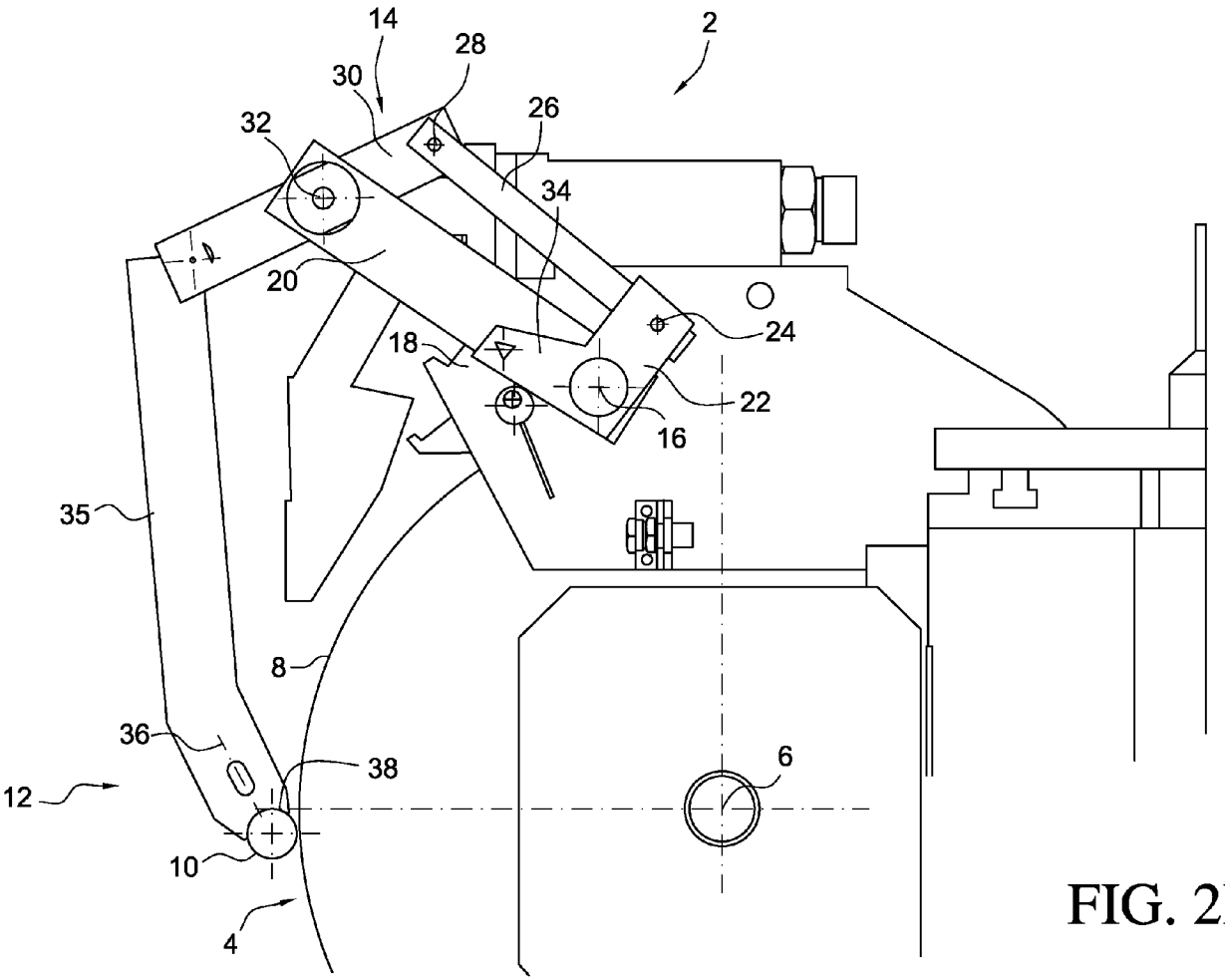

FIG. 2D depicts the measuring head 12 in its measuring position in which it is in contact with the crankpin 10.

Figure 2E:
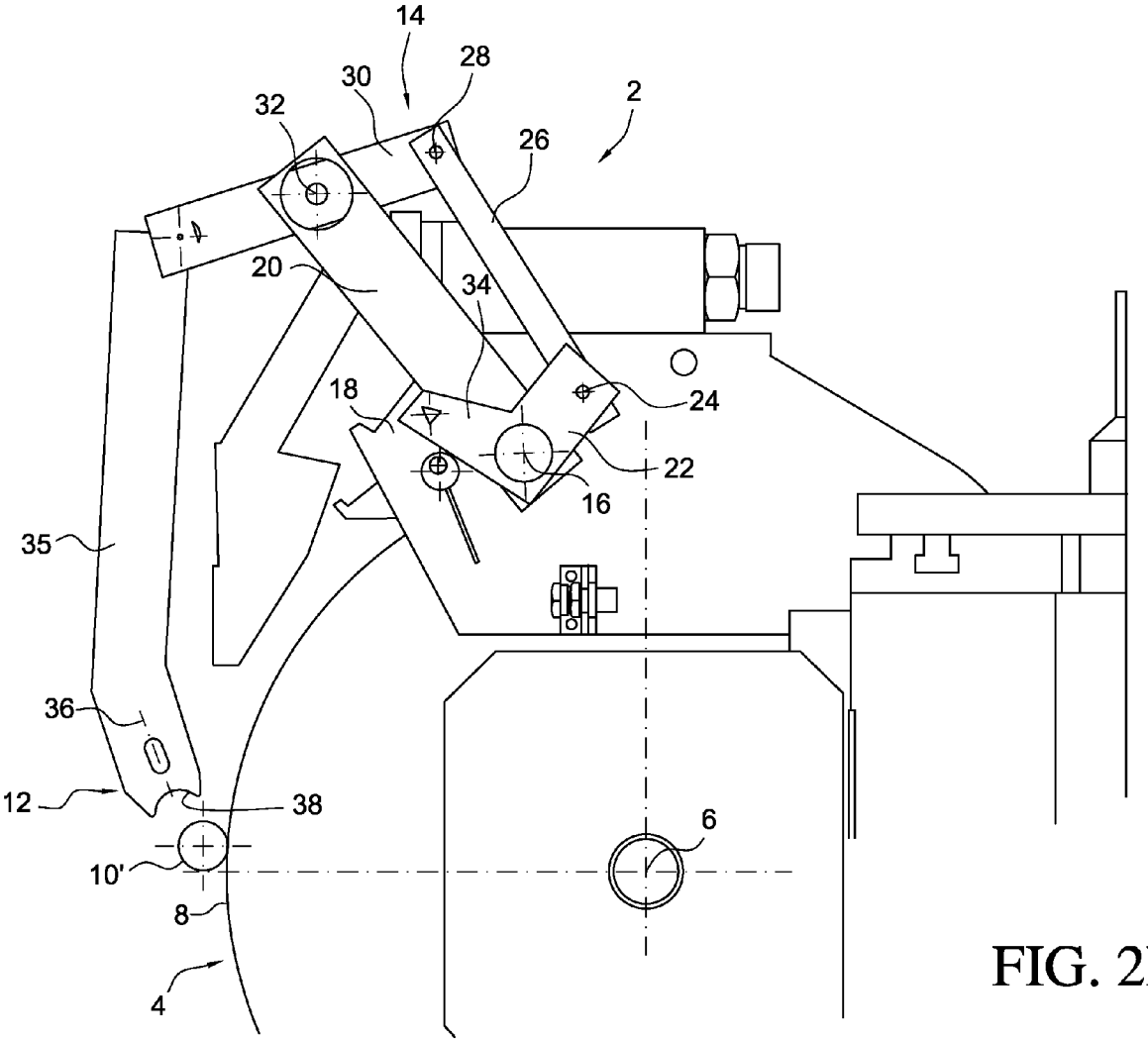

FIG. 2E corresponds to FIG. 2C, the measuring head 12 being depicted in its seek position with regard to a crankpin 10' having a larger diameter.

Figure 3:
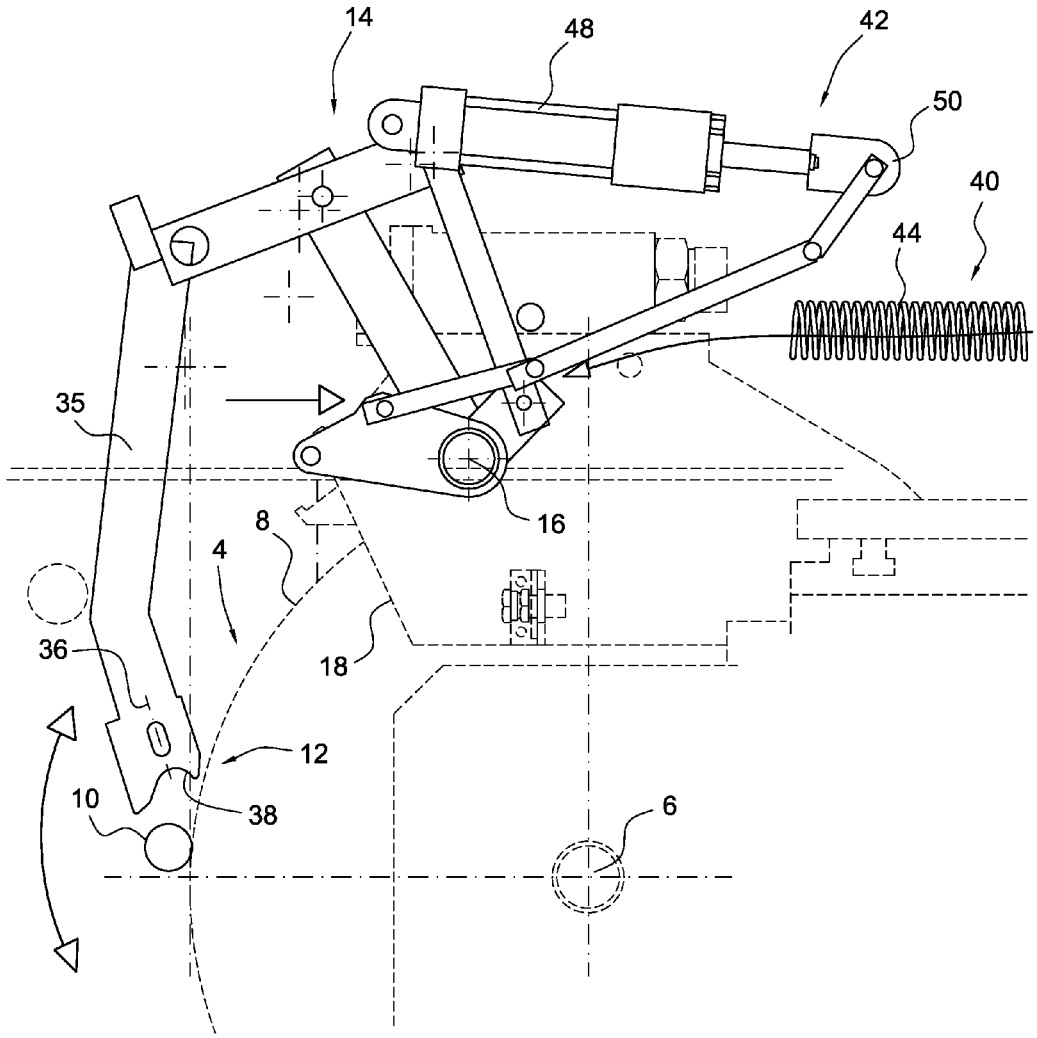
FIG. 3 is shown in the same manner as in FIG. 1 and depicts the embodiment according to FIG. 1 during the movement of the measuring head into the measuring position.

FIG. 3 depicts the measuring device 2 with the measuring head 12 in the seek position, as is also depicted in FIG. 2C. As can be seen by comparing FIG. 1 to FIG. 3, the lever 54 is pivoted counterclockwise by means of the lever arrangement 42 when the piston rod 50 of the hydraulic cylinder 48 in FIG. 1 is extended until the lever 54 has reached the angular position depicted in FIG. 3. As can be seen from FIG. 3, in this angular position the roller 56 is spaced apart, in the circumferential direction of the first rotational axis 16, from the first linkage element 20 so that the first linkage element 20 and thus the entire linkage 14, under the effect of the weight of the measuring head 12, including holding arm 34 and the compression force exerted by the spring 44, can move freely. In the measuring position (see FIG. 2D) the measuring head 12 is positioned against the crankpin 10, the measuring head reproducing orbital rotations of the crankpin 10 about the crankshaft during the grinding process. To this end the base body 18 of the measuring device 2 is connected displacement-fast to a retention element for the grinding wheel 8 so that the measuring device 2 follows translational movements by the grinding wheel 8 in the radial direction of the rotational axis 6.

While the measuring head 12 is in contact with the crankpin 10, the measuring sensor 36 records measured values that may be used in the evaluation computer downstream of the measuring sensor 36 to evaluate the roundness and/or diameter of the crankpin. If, for instance, a certain diameter is attained, the grinding wheel 8 is caused to disengage from the crankpin 10.

In order to pivot the measuring head 12 out against the inward pivot direction 46 after the measurement has ended, the control acts on the hydraulic cylinder 48 such that its piston rod 50 moves to the left in FIG. 3. The lever 54 is pivoted clockwise in FIG. 3 by way of the lever arrangement 42. As long as the roller 56 is spaced apart from the first linkage element 20 in the circumferential direction of the first pivot axis 16, the measuring head 12 initially remains in the measuring position. If, given further pivoting of the lever 54 clockwise in FIG. 3 about the pivot axis 16 the roller 56 comes to be positioned against the first linkage element 20, given further clockwise pivoting the lever 54 functions as an engaging element and carries the first linkage element 20, and thus the entire linkage 14, clockwise with it so that the measuring head is pivoted outward, opposite the inward pivot direction 46, until the rest position depicted in FIG. 1 is achieved.

During the measuring process, the measuring head moves in the circumferential direction of the crankpin 10 at an angular stroke that is about −7° and +5° in the embodiment depicted, that is, at total of 12°.

The inventive measuring device 2 is relatively simple in structure and is robust and maintenance-friendly. Thanks to the embodiment of the linkage 14 provided according to the invention, particularly favorable kinematics result when the measuring head 12 pivots in and out.

Figure 4A:
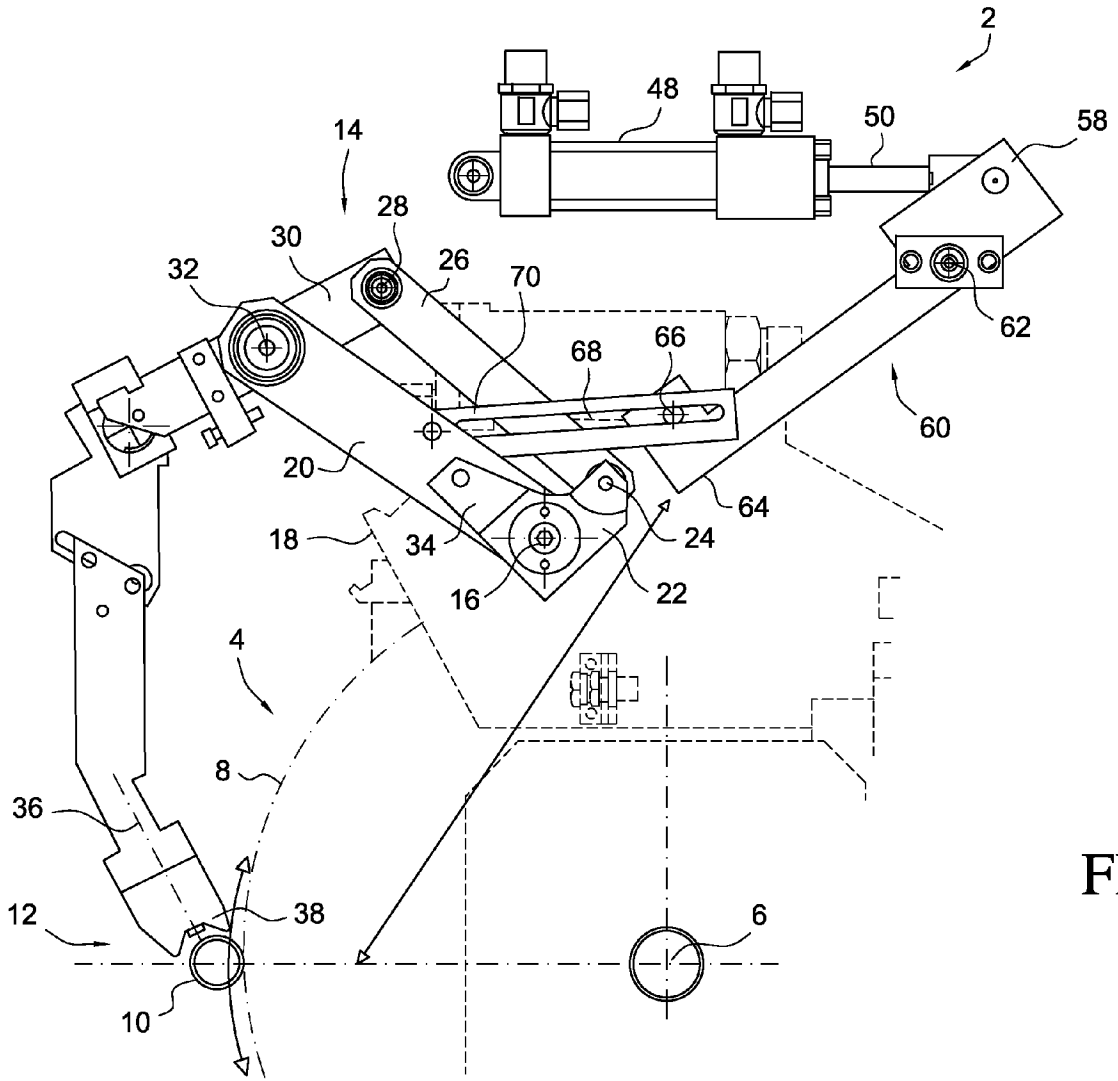
FIGS. 4A and 4B depict a further embodiment of a measuring device according to the invention, with the measuring head in two different positions.

FIG. 4A depicts a second embodiment of a device 2 according to the invention that is distinguished from the embodiment according to FIGS. 1 and 2 with regard to the outward pivot device 42. The outward pivot device 42 has a hydraulic cylinder 48, the piston of which is connected at its free end to a lever arm 58 of a two-armed lever 60 that can be pivoted about a pivot axis 62. The other lever arm 64 of the two-armed lever 16 has at its free end a pin 66 that is guided, longitudinally displaceable, in a longitudinal slot 68 of a bar 70, and its end that faces away from the two-armed lever 60 is connected to the first linkage element 20 at a distance from its end.

FIG. 4A depicts the measuring head 12 in the measuring position in which the measuring head 12 reproduces movements by the crankpin 10 and performs pivot movements about the first pivot axis 16, the pin 66 sliding in the longitudinal slot 68 of the bar 70 so that the measuring head can pivot freely about the first pivot axis 16.

For pivoting the measuring head 12 outward, the hydraulic cylinder is acted upon such that its piston rod moves to the left in FIG. 4*a*. This pivots the two-armed lever 60 counterclockwise in FIG. 4A about the pivot axis 62. Now the pin 66 comes to be positioned against the end of the longitudinal slot 68 of the bar 70 facing the lever 60 so that, given another pivot movement by the lever 60, the bar 70 is moved to the right in FIG. 4A. The first linkage element 20 is pivoted clockwise about the first pivot axis 16 so that the measuring head 12 can be pivoted out.

Figure 4B:
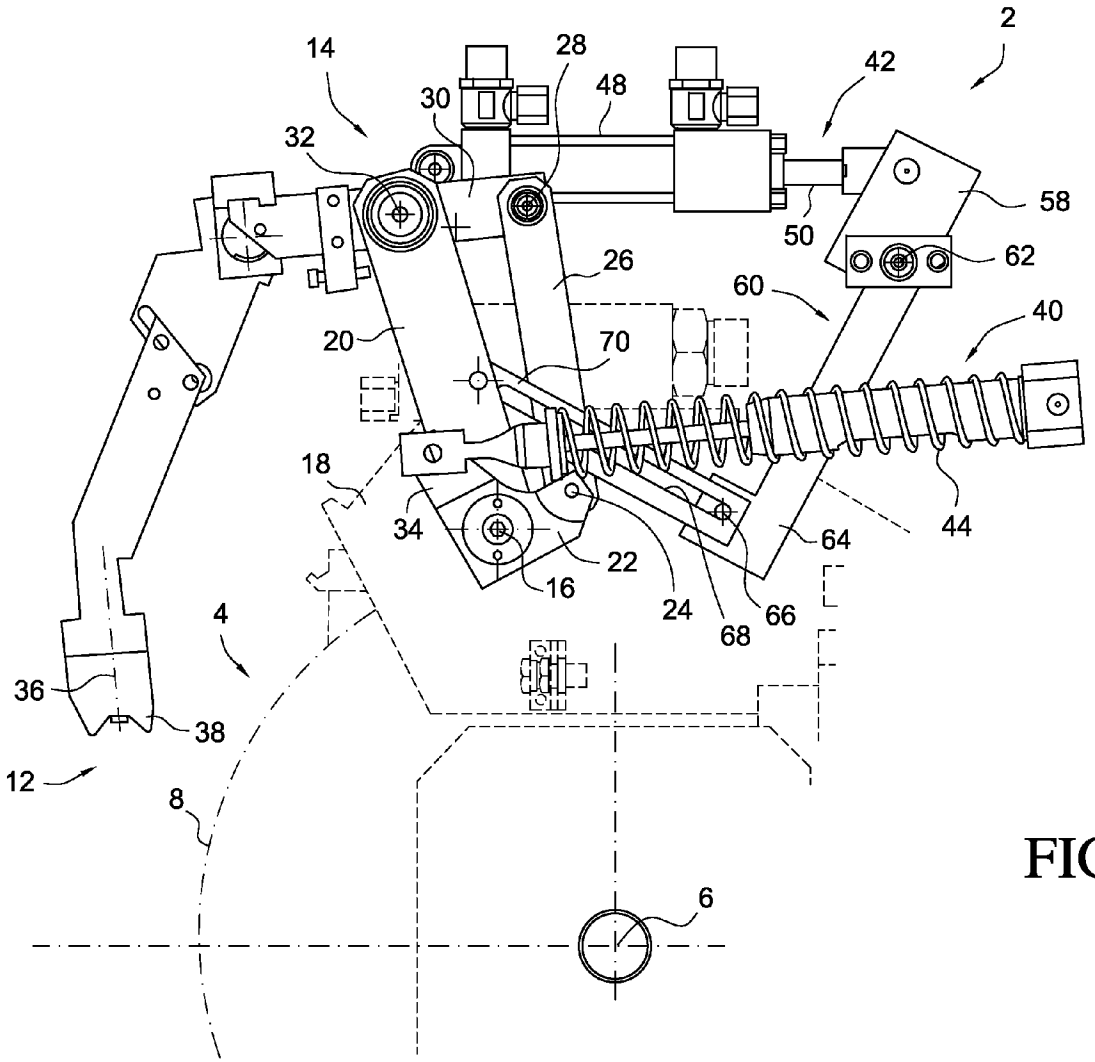

FIG. 4B depicts the measuring head 12 in the outward pivoted position.

Identical and corresponding components are provided with the same reference number in the figures in the drawings. FIGS. 2A through 2E depict a slightly modified variant of the embodiment according to FIG. 1 and FIG. 3 that however, with respect to the basic principle according to the invention, agrees with the embodiment according to FIG. 1 and FIG. 3.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. Measuring device for in-process measurement of test specimens during a machining process on a machine tool having a base body, comprising:

a) a measuring head connected pivotably about a first pivot axis to the base body of the measuring device via a linkage;

b) an apparatus provided for pivoting the measuring head in and out of a measuring position, respectively;

c) a linkage provided including:

i) a first linkage element and a second linkage element that are provided pivotably on the first pivot axis;

ii) a third linkage element connected pivotably about a second pivot axis to the end of the second linkage element facing away from the first pivot axis; and iii) a fourth linkage element connected pivotably about a third pivot axis to the end of the third linkage element that faces away from the second pivot axis, and the fourth linkage element being connected pivotably about a fourth pivot axis to the first linkage element at a distance from the third pivot axis.

2. Measuring device according to claim 1, wherein:

a) the first linkage element and the third linkage element are provided non-parallel to one another.

3. Measuring device according to claim 2, wherein:

a) the distance between the first pivot axis and the second pivot axis is shorter than the distance between the third pivot axis and the fourth pivot axis.

4. Measuring device according to claim 1, wherein:

a) the measuring head is arranged on a holding arm that is connected to the fourth linkage element.

5. Measuring device according to claim 4, wherein:

a) the holding arm is rigidly connected to the fourth linkage element.

6. Measuring device according to claim 4, wherein:

a) a free end of the holding arm holding the measuring head is angled or bent towards the first pivot axis.

7. Measuring device according to claim 2, wherein:

a) a part of the holding arm that is connected to the associated linkage element and the associated fourth linkage element form an angle greater than 90°.

8. Measuring device according to claim 1, wherein:

a) the measuring head has at least one linearly displaceable measuring sensor.

9. Measuring device according to claim 1, wherein:

a) the measuring head has at least one measuring prism.

10. Measuring device according to claim 1, wherein:

a) the apparatus for pivoting the measuring head in and out has at least one linear drive with a linearly movable drive unit and an apparatus for converting a linear movement by the drive unit to a pivot movement of the measuring head.

11. Measuring device according to claim 1, wherein:

a) the apparatus for pivoting the measuring head in and out engages the linkage.

12. Measuring device according to claim 1, wherein:

a) the apparatus for pivoting the measuring head in and out has a common inward and outward pivot device.

13. Measuring device according to claim 1, wherein:

a) the apparatus for pivoting the measuring head in and out has at least one inward pivot device and at least one separate outward pivot device.

14. Measuring device according to claim 1, wherein:

a) the apparatus for pivoting the measuring head in and out has a spring device with at least one spring that acts on the measuring head.

15. Measuring device according to claim 14, wherein:

a) the at least one spring is arranged between the base body of the measuring device and a part of the linkage element of the linkage.

16. Measuring device according to claim 15, wherein:

a) at least the second linkage element has a lever arm such that the lever arm, together with the second linkage element forms a two-armed lever, and in that the spring acts on the lever arm.

17. Measuring device according to claim 16, wherein:

a) the at least one spring is a compression spring.

18. Measuring device according to claim 1, wherein:

a) the apparatus for pivoting the measuring head in and out includes at least one hydraulic cylinder that is mechanically linked to the measuring head for pivoting the latter in or out.

19. Measuring device according to claim 18, wherein:

a) an engaging element is provided for pivoting the measuring head out, and the engaging element acts on the measuring head or a part connected thereto, especially a linkage element), causing it to pivot outward.

20. Measuring device according to claim 19, wherein:

a) the engaging element is configured as a lever carried pivotably about the pivot axis.

21. Measuring device according to claim 19, wherein:

a) the engaging element is operatively connected to the hydraulic cylinder.

22. Measuring device according to claim 19, wherein:

a) the engaging element is operatively connected via a lever arrangement to a drive element of the apparatus for pivoting the measuring head in and out.

23. Measuring device according to claim 22, wherein:

a) the lever arrangement has a knee lever.

24. Measuring device according to claim 1, wherein:

a) a sensor is provided for sensing the respective position of the measuring head.

25. Measuring device according to claim 1, wherein:

a) a control is provided for controlling the means for pivoting the measuring head in and out.

26. Measuring device according to claim 25, wherein:

a) the control is operatively connected to the sensor.

27. Measuring device according to claim 1, wherein:

a) the apparatus for pivoting the measuring head in and out of a measuring position during a machining process on the machine tool is configured for pivoting the measuring head in and out of a measuring position on a grinding machine.

* * * * *